US006506091B1

(12) United States Patent
Garpow

(10) Patent No.: US 6,506,091 B1
(45) Date of Patent: Jan. 14, 2003

(54) COMBINATION TOY BUILDING BLOCK AND CONTAINER FOR HOLDING LIQUIDS AND THE LIKE

(76) Inventor: Scott Garpow, 342 Log Cabin Rd., #11E, Milledgeville, GA (US) 30161

( * ) Notice: Subject to any disclaimer, the term of this patent is extended or adjusted under 35 U.S.C. 154(b) by 0 days.

(21) Appl. No.: 10/021,816

(22) Filed: Nov. 29, 2001

(51) Int. Cl.[7] ..... A63H 33/04

(52) U.S. Cl. ..... 446/75; 446/85; 446/124; 446/267; 220/4.27; 220/23.4; 220/23.6; 206/216

(58) Field of Search ..... 446/71.85, 75, 446/76, 117, 124, 125, 128, 267; 206/216; 220/4.27, 23.4, 23.6, 752, 761, 767, 770; 434/171, 403; 273/156, 157 R

(56) References Cited

U.S. PATENT DOCUMENTS

| | | | | | |
|---|---|---|---|---|---|
| 2,057,972 | A | * | 10/1936 | Pieck | 206/216 |
| 3,889,834 | A | | 6/1975 | Harris, Jr. | |
| D249,230 | S | | 9/1978 | Van Der Veken | |
| D252,910 | S | | 9/1979 | Bayly | |
| D261,362 | S | | 10/1981 | Epperson | |
| 4,570,799 | A | | 2/1986 | Mednis | |
| 4,656,840 | A | * | 4/1987 | Loofbourrow et al. | 215/10 |
| 4,691,828 | A | * | 9/1987 | Slusarczyk et al. | 206/509 |
| 5,000,713 | A | * | 3/1991 | Cheng | 273/160 |
| 5,007,551 | A | | 4/1991 | Baroi | |
| 5,067,922 | A | | 11/1991 | McMahon | |
| D325,519 | S | | 4/1992 | Proctor | |
| D333,978 | S | | 3/1993 | Zutler | |
| D349,046 | S | | 7/1994 | Brown | |
| 5,493,816 | A | * | 2/1996 | Willemsen | 446/104 |
| 5,516,322 | A | * | 5/1996 | Myers | 446/267 |
| D371,281 | S | | 7/1996 | Credle, Jr. | |
| D377,887 | S | | 2/1997 | Credle, Jr. | |
| 5,782,358 | A | * | 7/1998 | Walker | 206/509 |
| D412,646 | S | | 8/1999 | Credle, Jr. | |
| D412,662 | S | | 8/1999 | Giskeodegaard et al. | |

* cited by examiner

*Primary Examiner*—Derris H. Banks
*Assistant Examiner*—Bena B. Miller
(74) *Attorney, Agent, or Firm*—Myers & Kaplan, Intellectual Property Law, L.L.C.; Joel D. Myers

(57) ABSTRACT

A combination toy building block and container for holding liquids and the like having male connectors formed on one side of the container and female receptacles formed on an opposing side, wherein a male connector is threadably engaged with the container side such that it can be unscrewed to allow dispensing of the container's contents, and wherein a protrusion is recessed within one of the female receptacles for holding and/or carrying of the container. Identical containers or similar containers possessing similarly dimensioned male connectors and female receptacles can be connected to one another and/or stacked by engaging the male connectors of a first container with the female receptacles of a second container, and so on, essentially providing toy building blocks.

8 Claims, 6 Drawing Sheets

COMBINATION TOY BUILDING BLOCK AND CONTAINER FOR HOLDING LIQUIDS AND THE LIKE

TECHNICAL FIELD

The present invention relates generally to containers, and more specifically to a combination toy building block and container for holding liquids and the like.

BACKGROUND OF THE INVENTION

Most parents would probably agree that a child's creative mind could turn almost any common household item into a toy. From soup-can-telephones to cardboard-box-racecars to blanket-broom-forts, most children can typically turn common household items into wondrous and imaginative creations.

Containers in general, have been traditionally recognized as serving one primary purposes, that of containing or holding substances such as liquids or granulates. More often than not, after depletion of a container's contents, the empty container is deemed useless and thus discarded, thereby becoming an environmental burden. Those retained may serve limited uses as temporary canisters for miscellaneous items or as accessories for a child's arts and crafts. However, even if employed in a child's arts and crafts, most containers have limited functionality, and typically do not serve as entertaining toys.

Therefore, it is readily apparent that there is a need for a combination toy building block and container for holding liquids and the like, wherein the container has a functional configuration that allows it to both carry a dispensable substance and be interlockingly stacked on similar containers for building most any play toy such as, but not limited to, play forts/houses, play cars and boats, statues, tables and chairs.

BRIEF SUMMARY OF THE INVENTION

Briefly described, in a preferred embodiment, the present invention overcomes the above-mentioned disadvantages, and meets the recognized need for such a device by providing a combination toy building block and container for holding liquids and the like, wherein the functional configuration of the device permits both the carrying of a dispensable substance and the stacking of multiple containers, thereby enabling the imaginative play construction of buildings and objects such as, but not limited to, play forts, play houses, play cars and boats, statues, tables and chairs.

According to its major aspects and broadly stated, the present invention in its preferred form is a combination toy building block and container for holding liquids and the like having male connectors, female receptacles and a protrusion recessed within one of the female receptacles.

More specifically, the present invention is a combination toy building block and container for holding liquids and the like having male connectors formed on one side of the container and female receptacles formed on an opposing side, wherein at least one of the male connectors is preferably threadably engaged with the container side such that at least one male connector can be unscrewed to allow dispensing of the container's contents, and wherein a protrusion is recessed within one of the female receptacles for holding and/or carrying of the container. Containers possessing correspondingly dimensioned male connectors and female receptacles can be connected to one another and/or stacked by engaging the male connectors of a first container with the female receptacles of a second container, and so on, essentially providing toy building blocks.

A feature and advantage of the present invention is its ability to provide a toy building block.

A feature and advantage of the present invention is its ability to carry and hold liquids, granulates or any other chosen substance.

A feature and advantage of the present invention is its ability to be generally interlockingly connected to correspondingly dimensioned toy building block containers.

A feature and advantage of the present invention is its ability to be easily utilized by children.

A feature and advantage of the present invention is its ability to provide access to container contents for quick and easy dispensing thereof.

A feature and advantage of the present invention is its ability to be reused as a storage receptacle by simply refilling the container with a desired substance.

A feature and advantage of the present invention is its ability to function as a container yet possess an aesthetically pleasing appearance, thereby facilitating a child's belief that the container is a genuine toy building block.

A feature and advantage of the present invention is its ability to provide a container with a recessed protrusion, wherein the protrusion will not interfere with the connection and/or stacking of multiple containers, thereby enabling the containers to be used as toy building blocks or to be stacked for transport from one location to another.

These and other objects, features and advantages of the invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND ALTERNATIVE EMBODIMENTS

Figure 1:
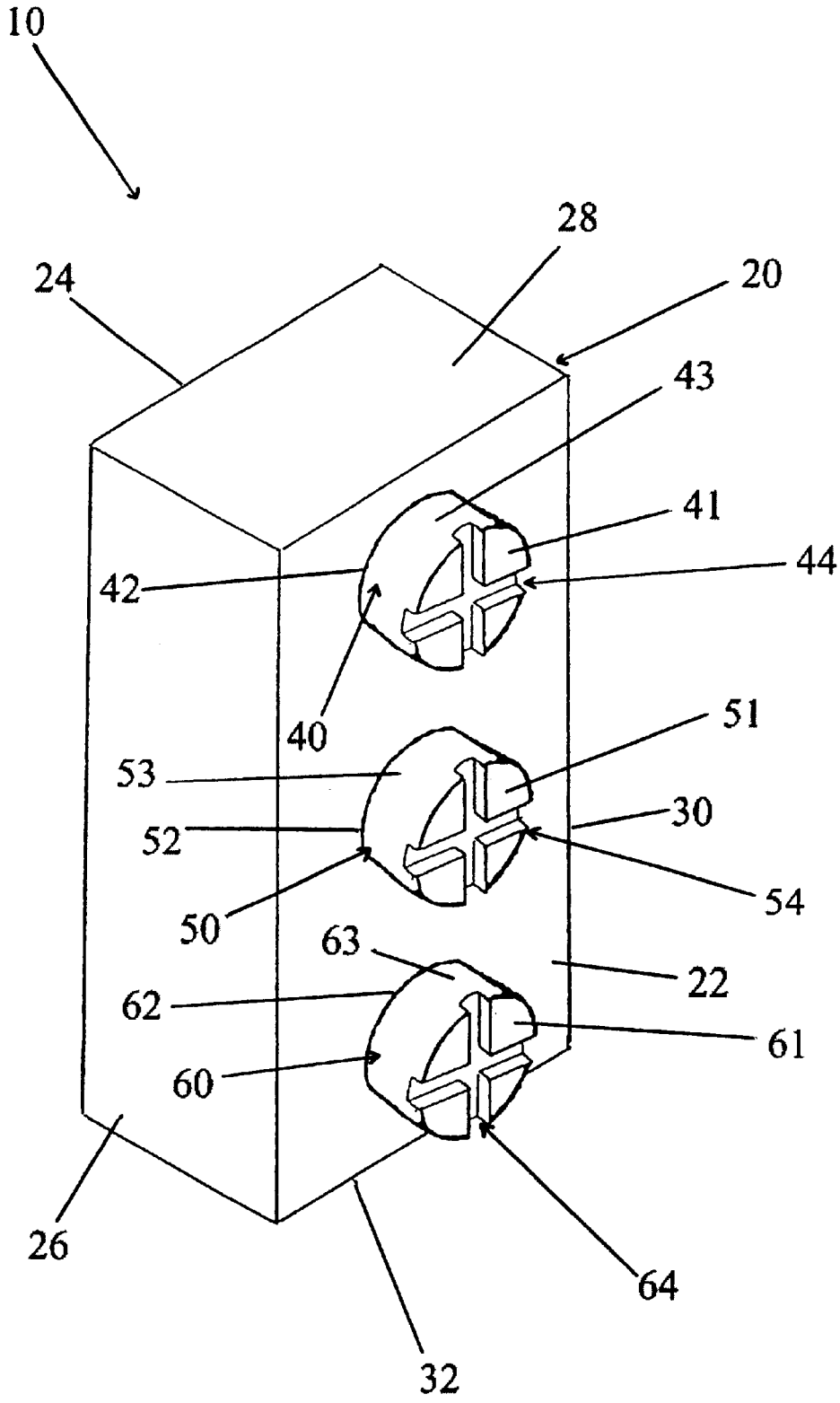
FIG. 1 is a front perspective view of a combination toy building block and container for holding liquids and the like according to a preferred embodiment of the present invention.
Figure 2:
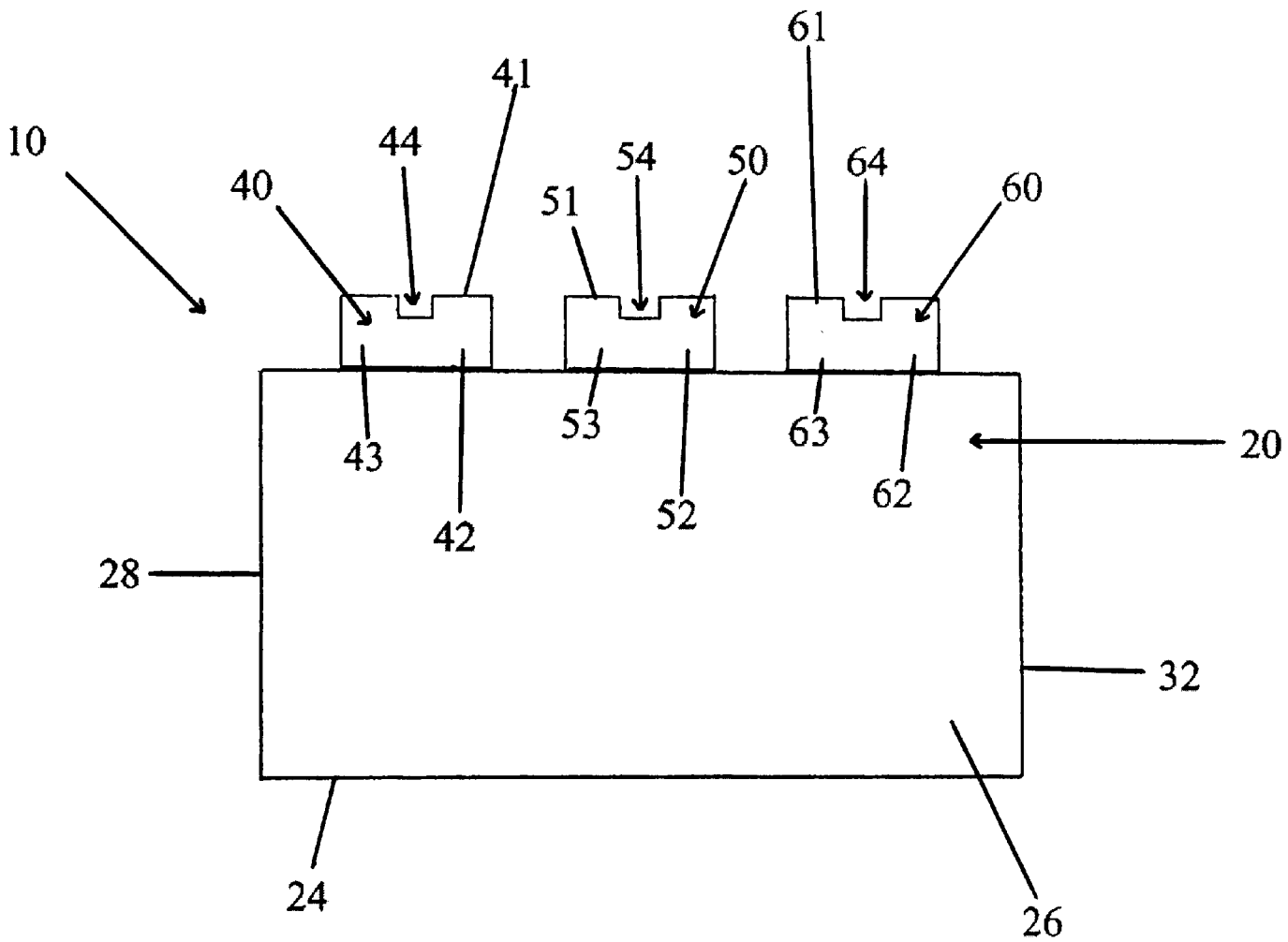
FIG. 2 is a side view of a combination toy building block and container for holding liquids and the like according to a preferred embodiment of the present invention.
Figure 3:
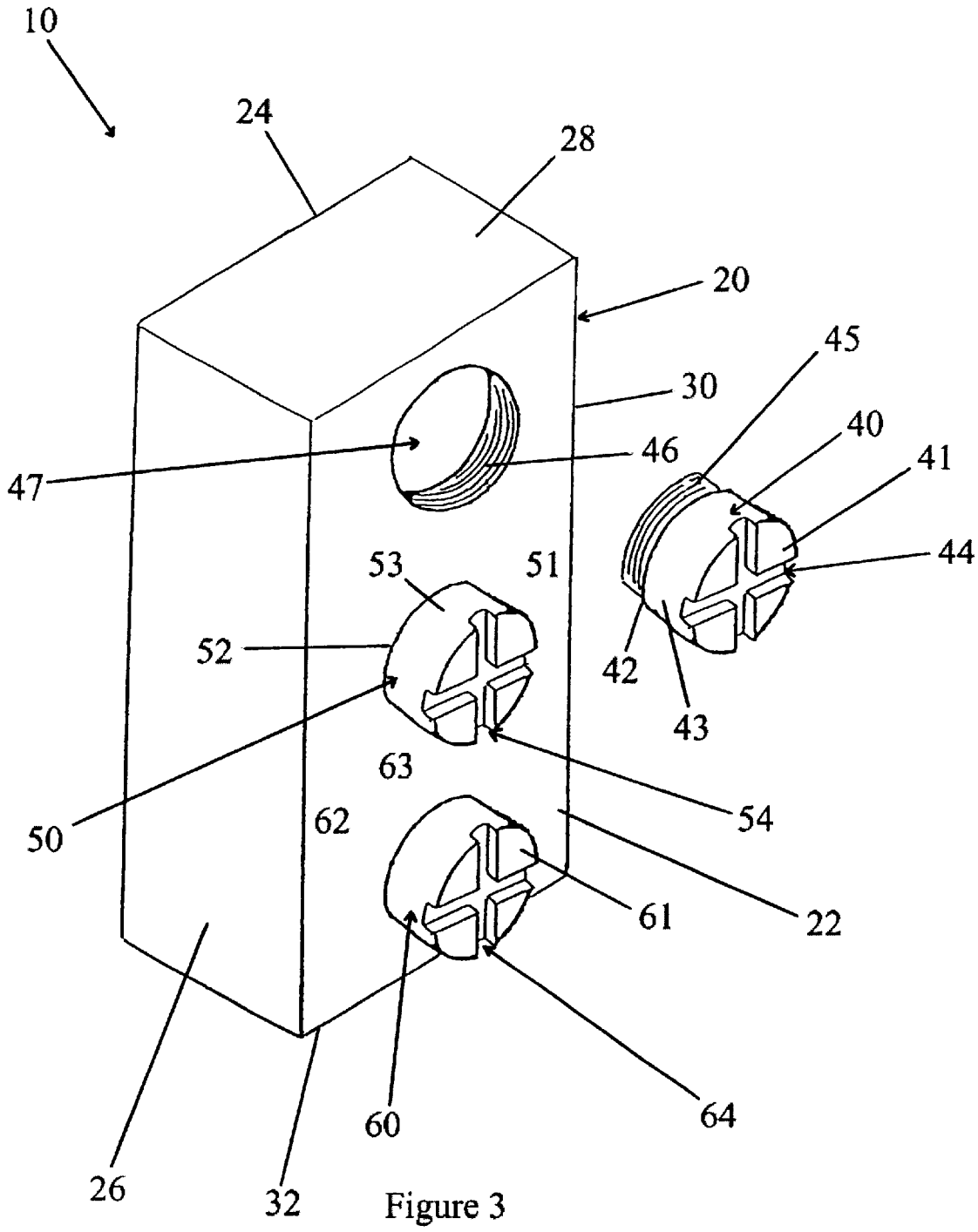
FIG. 3 is a front perspective view of a combination toy building block and container for holding liquids and the like according to a preferred embodiment of the present invention showing one of the male connectors unscrewed.
Figure 4:
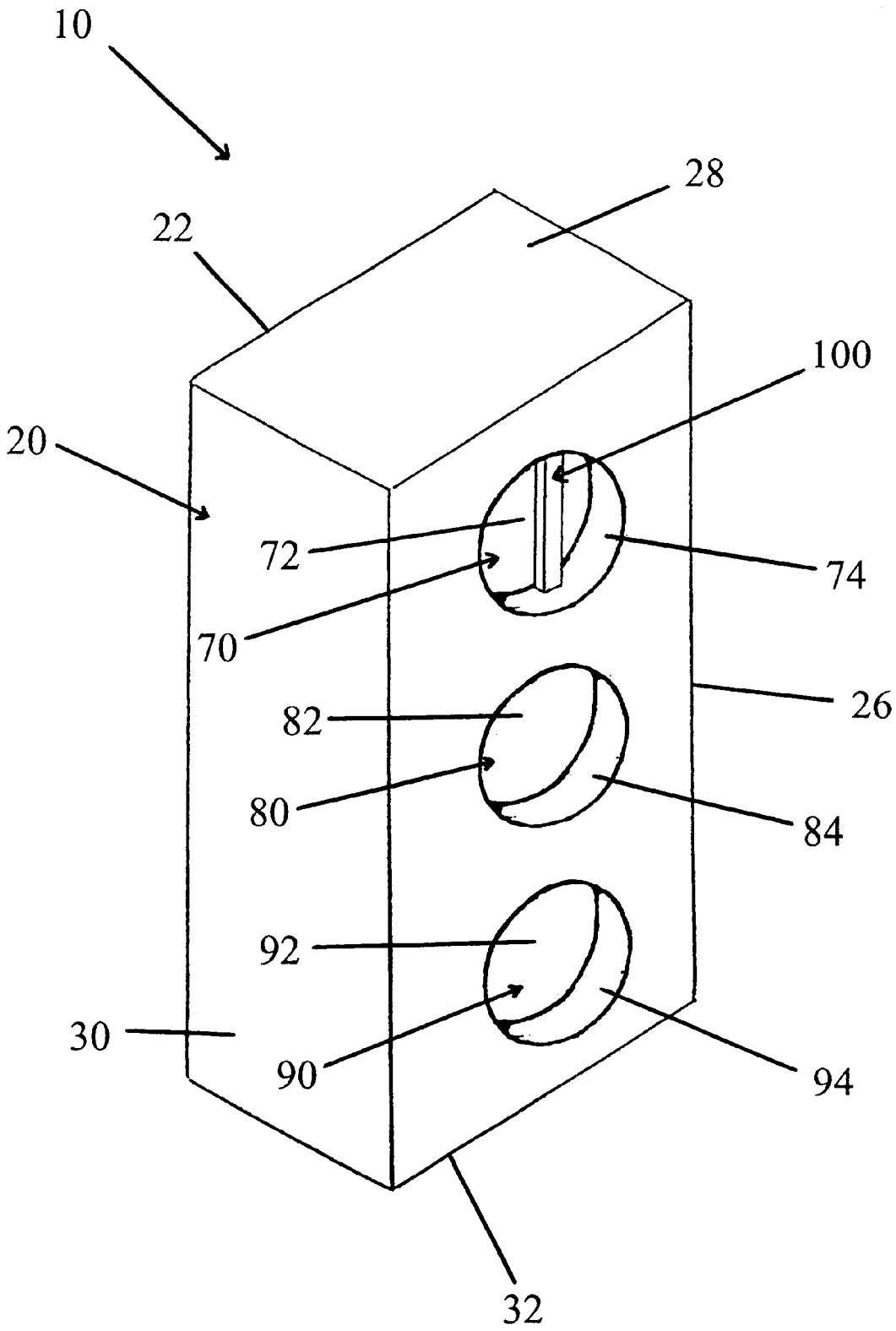
FIG. 4 is a back perspective view of a combination toy building block and container for holding liquids and the like according to a preferred embodiment of the present invention showing a protrusion recessed within one of the female receptacles.

In describing the preferred and alternate embodiments of the present invention, as illustrated in FIGS. 1–6, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 1–4, the present invention in its preferred embodiment is a device 10, wherein device 10 is a combination toy building block and container for holding liquids and the like generally comprising a container 20, male connectors 40, 50 and 60, female receptacles 70, 80 and 90 and a protrusion 100.

Specifically, container 20 is preferably substantially rectangular shaped and comprises a top side 22, a bottom side 24, sidewalls 26, 28, 30 and 32, wherein sidewalls 26, 28, 30 and 32, top side 22 and bottom side 24 together form container 20. It is recognized that container 20 may define an alternate, suitable shape such as, for exemplary purposes only, square, triangular, circular, diamond or trapezoidal. Further, although it is preferred that container 20 be formed from plastic material, it is contemplated in alternate embodiments that container 20 can be formed from any suitable material known within the art, such as, for exemplary purposes only, other synthetic material, metal or wood.

Top side 22 of container 20 has disposed thereon preferably three aligned and equally spaced male connectors 40, 50 and 60, wherein male connectors 40, 50 and 60 are preferably substantially circular shaped. Although it is preferred that container 20 possess three aligned and equally spaced male connectors, it is contemplated in alternate embodiments that container 20 could contain any number of male connectors and that such connectors could be in an unequally spaced and/or unaligned configuration such as, for exemplary purposes, a domino or die configuration. Male connectors 40, 50 and 60 preferably comprise a top surface 41, 51 and 61, respectively, a bottom surface 42, 52 and 62, respectively, and a peripheral side wall 43, 53 and 63, respectively, adjoining respective top surfaces 41, 51 and 61 and bottom surfaces 42, 52 and 62. Preferably formed on top surfaces 41, 51 and 61 are X-shaped channels 44, 54, and 64, respectively. Although the preferred shape of channels 44, 54 and 64 is X-shaped, it is contemplated in alternate embodiments that channels 44, 54 and 64 could be any shape, such as, for exemplary purposes only, I-shaped, V-shaped or any other suitable shape.

Formed preferably on bottom surface 42 of male connector 40 is a threaded engagement 45, dimensioned for reception by a threaded interface 46 formed on top side 22 of container 20. Although the preferred shape of male connectors 40, 50 and 60 is circular, it is contemplated in alternate embodiments that other suitable shapes may be used, such as, for exemplary purposes only, triangular, square or diamond, wherein threaded engagement 45 would retain a generally circular shape facilitating reception by threaded interface 46.

Male connector 40 is preferably removed from container 20 via separation of threaded engagement 45 from threaded interface 46, thus allowing access to and/or dispensing of the contents of container 20 via aperture 47. Although it is preferred that male connector 40 alone comprises threaded engagement 45 to removably secure to container 20 via threaded interface 46, thereby enabling access to the contents of container 20, it is contemplated in an alternate embodiment that male connector 50, male connector 60 or any combination of male connectors 40, 50 and 60 could comprise threaded engagements formed thereon for engagement with and/or removal from respective threaded interfaces formed on top side 22 of container 20 to permit additional access to the contents of container 20. Moreover, while a threaded mechanism is preferred, alternate means of removably securing male connectors 40, 50 and/or 60 to container 20 could be utilized, such as, for exemplary purposes only, rubberized pressure sensitive ridges, pressure sensitive locking beads or alternatively male connectors 50 and 60 could be integrally formed with container 20.

Preferably, bottom side 24 of container 20 has defined therein preferably three aligned and equally spaced female receptacles 70, 80 and 90, wherein female receptacles 70, 80 and 90 are preferably substantially circular shaped and dimensioned to receive male connectors 40, 50 and 60 of a second container 20 or a similar container possessing similarly dimensioned and similarly aligned male connectors. Although the preferred shape of female receptacles 70, 80 and 90 is circular, it is contemplated in alternate embodiments that other suitable shapes may be used, such as, for exemplary purposes only, triangular, square or diamond, wherein the contemplated shape corresponds to the shape of male connectors 40, 50 and 60 of a second container 20 or a similar container possessing similarly dimensioned and similarly aligned male connectors. Furthermore, although it is preferred that container 20 possess three female receptacles, it is contemplated in an alternate embodiment that container 20 could contain any number of female receptacles, and that any such receptacles could be alternately spaced or aligned, wherein an appropriate corresponding relationship remains with male connectors 40, 50 and/or 60 as required.

Specifically, female receptacles 70, 80 and 90 are preferably defined by a bottom wall 72, 82 and 92, respectively, and peripheral sidewall 74, 84 and 94, respectively. Protrusion 100 is preferably attached to peripheral sidewall 74 of female receptacle 70 in a generally recessed position. Handle 100 is preferably elongated rectangular shaped and is preferably dimensioned to be received within preferably X-shaped channel 44, 54 or 64 of inserted male connector 40, 50 or 60, respectively. Preferably, protrusion 100 extends across female receptacle 70 substantially parallel with sidewalls 26 and 30, wherein a first end thereof is proximate sidewall 28 of container 20. Alternatively, protrusion 100 could extend across female receptacle 70, substantially perpendicular to sidewalls 26 and 30 and substantially parallel with sidewalls 28 and 32.

Although it is preferred that female receptacle 70 comprise protrusion 100, it is contemplated in an alternate embodiment that female receptacles 80 and 90 could also possess handles attached to peripheral side walls 84 and 94, respectively, and be dimensioned for reception by one channel of X-shaped channel 44, 54 or 64 depending upon which male connector, 40, 50 or 60, respectively, is inserted into female receptacles 80 and 90. It is further contemplated in an alternate embodiment that protrusion 100 could also be X-shaped for receipt by both channels of X-shaped channels 44, 54 or 64 upon connection or stacking of an identical container 20 or similar container possessing similarly dimensioned and similarly aligned male connectors. Additionally, channels 44, 54 or 64 could be most any suitable shape such as, for exemplary purposes only, plus symbol shaped or I-shaped. Furthermore, female receptacles 70, 80 and 90 could possess raised portions recessed therein and dimensioned to be received within channels 44, 54 and 64 of male connectors 40, 50 and 60.

Figure 5:
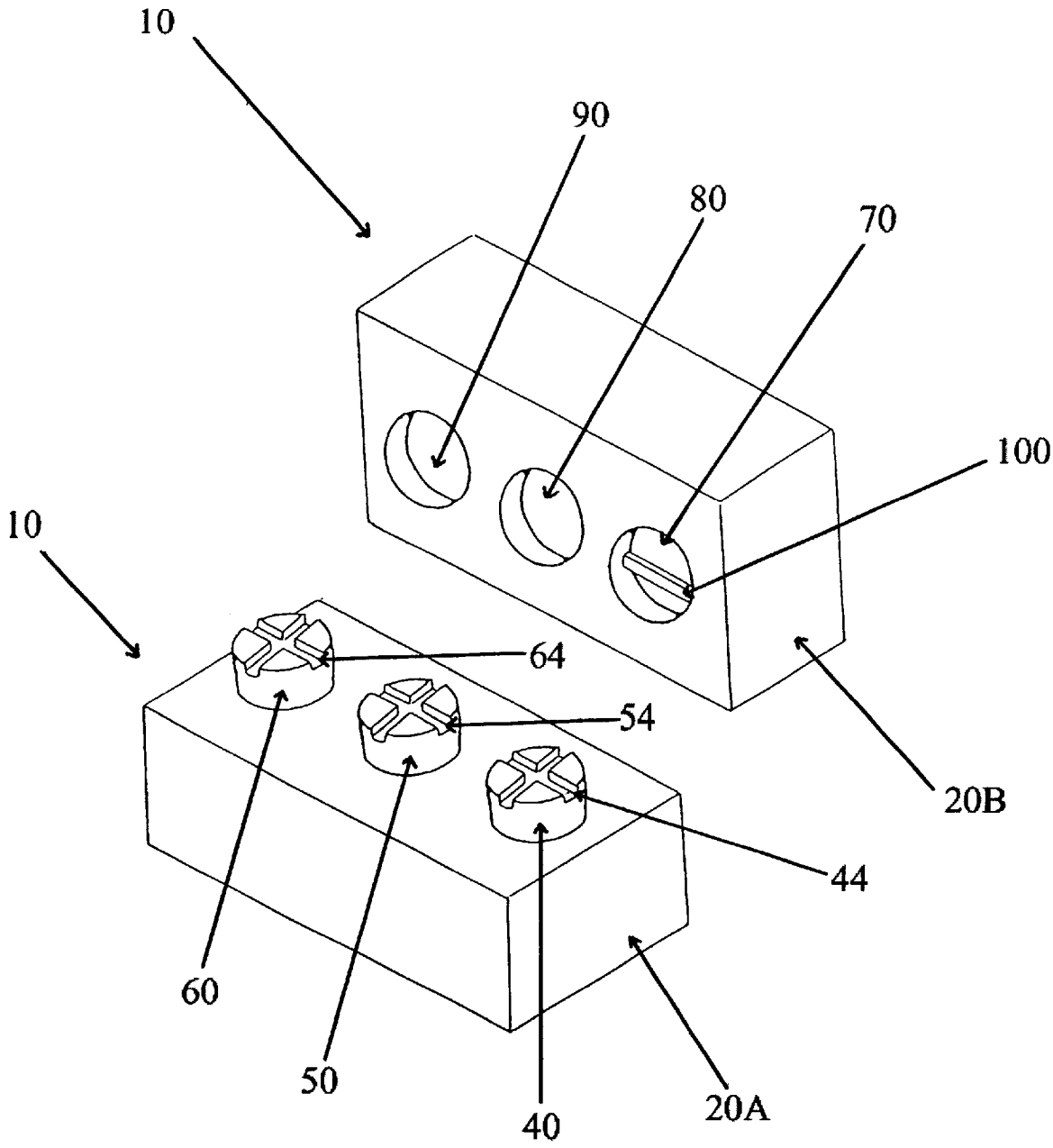
FIG. 5 is a side perspective view of a combination toy building block and container for holding liquids and the like according to a preferred embodiment of the present invention showing the device in use.

Referring now to FIG. 5, when container 20 is being utilized as a toy building block, first container 20A (or similar container possessing similarly dimensioned and similarly aligned male and female connectors) is connected to second container 20B by engaging male connectors 40, 50 and 60 of container 20A with female receptacles 70, 80, and 90, respectively, of container 20B such that male connectors 40, 50 and 60 substantially recess within female receptacles 70, 80, and 90, respectively, to interlock first container 20A with second container 20B, wherein top side 22 of container 20A is proximate to bottom side 24 of second container 20B. To interlock first container 20A with second container 20B in an alternate configuration, male connectors 40, 50 and 60 of first container 20A are engaged with female receptacles 90, 80 and 70, respectively, of second container 20B. Numerous such containers 20 may be connected in such a manner. Alternatively, a container 20A and a container 20B may be connected via insertion of a single male connector 40, 50 or 60 of container 20A into any one of female receptacles 70, 80 or 90 of container 20B. Further, a container 20A and a container 20B may be connected via insertion of two adjacent male connectors 40 and 50 or 50 and 60 of container 20A into any two adjacent female receptacles 70 and 80 or 80 and 90, respectively, of container 20B. Moreover, a container 20A and a container 20B may be connected via insertion of male connector 50 of container 20A into female receptacle 80 of container 20B SO as to form an X-shaped building block configuration. In yet another configuration, a container 20A and a container 20B may be connected via insertion of male connector 40 or 60 of container 20A into female receptacle 70 or 90, respectively, of container 20B so as to form an L-shaped building block configuration. In essence, multiple containers 20 can be connected and built upon one another to create a multitude of toy building block configurations.

Figure 6:
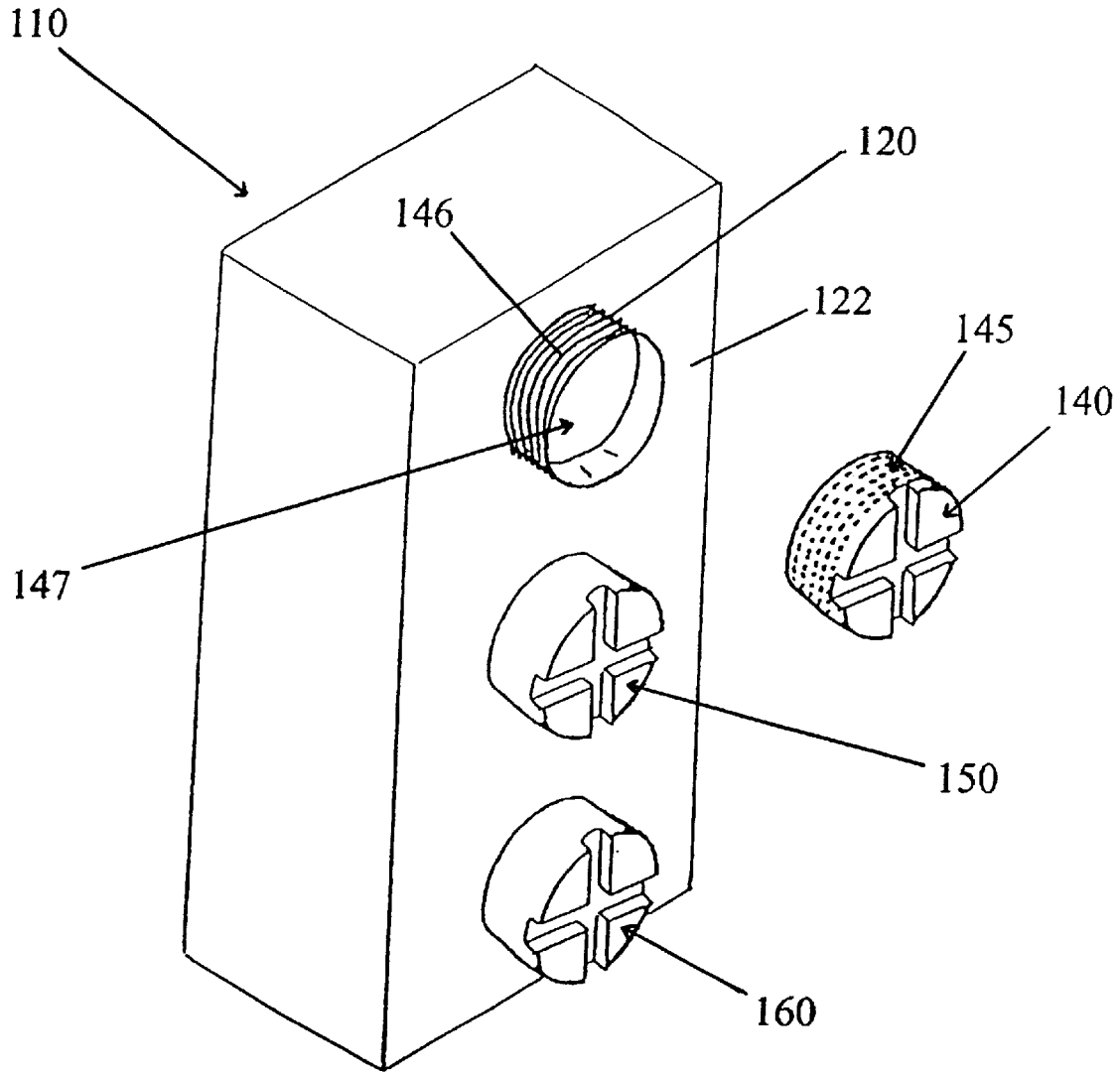
FIG. 6 is a front perspective view of a combination toy building block and container for holding liquids and the like according to an alternate embodiment of the present invention.

Referring now to FIG. 6, in an alternate embodiment, container 120 of device 110 could have male connectors 140, 150 and 160, wherein male connector 140 has an internally threaded interface 145 dimensioned to be received by a threaded lip 146 formed on top side 122 of container 120, and wherein lip 146 functions as a spout for the pouring and/or dispensing of the contents of container 120. Male connector 140 is removed from container 120 via separation of internally threaded interface 145 of male connector 140 from threaded lip 146 of container 120, thus allowing access to and/or dispensing of the contents of container 120 via aperture 147. Although male connector 140 alone could comprise internally threaded interface 145 to removably secure to container 120 via threaded lip 146 of container 120, thereby enabling access to the contents of container 120, it is further contemplated that male connector 150, male connector 160 or any combination of male connectors 140, 150 and 160 could comprise internally threaded interfaces formed thereon for engagement with and/or removal from respective threaded lips formed on top side 122 of container 120 to permit additional access to the contents of container 120. Moreover, while a threaded mechanism is preferred, alternate means of removably securing male connectors 140, 150 and/or 160 to container 120 could be utilized, such as, for exemplary purposes only, rubberized pressure sensitive ridges, pressure sensitive locking beads or alternatively male connectors 150 and 160 could be integrally formed with container 120.

In another alternate embodiment, top side 22 and bottom side 24 of container 20 could contain rows of male connectors and female connectors, respectively.

In another alternate embodiment, sidewalls 26, 28, 30 and 32 could also contain male connectors or female receptacles so as to increase the number of different configurations in which containers 20 could be connected.

In another alternate embodiment, container 20 could have only one male connector and only one female receptacle provided thereon.

In yet another alternate embodiment, at least one surface or side of container 20 could have at least one male connector and at least one female receptacle provided thereon.

In still another alternate embodiment, container 20 could be manufactured from an opaque or transparent material.

In yet another alternate embodiment, the male connectors could be dome shaped.

In still another alternate embodiment, the handle could have extending and retracting or telescoping capabilities.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A combination toy building block and container for holding liquids comprising:

a combination toy building block and a container having at least one outer wall defining an interior cavity;

at least one male member disposed on said combination toy building block and container;

at least one female receptacle defined on said combination toy building block and container, wherein said at least one male member is engageable with said at least one female receptacle; and a protrusion recessed within said at least one female receptacle, said protrusion dimensioned to be received by a channel formed on said at least one male member upon engagement of said at least one male member with said at least one female receptacle.

2. The combination toy building block and container of claim 1, wherein said at least one male member is carried by said outer wall, and wherein said at least one female receptacle is defined opposite thereof on said outer wall.

3. The combination toy building block and container of claim 1, wherein said at least one male member comprises an outer surface having at least one channel defined therein.

4. The combination toy building block and container of claim 3, wherein at least one of said at least one male member is removable from said container to expose said interior cavity, said at least one of said at least one male member further comprising a threaded portion and said container further comprising a threaded access to said interior cavity such that said threaded portion of said at least one male member engages with said threaded access.

5. The combination toy building block and container of claim 3, wherein at least one female receptacle of a first container is dimensioned to receive said at least one male member of a second said container.

6. A combination interlocking toy and reusable canister, comprising:

a hollow canister;

at least one removable projecting key defined on said canister, said at least one removable projecting key having at least one recess defined therein; and at least one keyhole defined on said canister, said keyhole dimensioned to receive a projecting key, wherein said at least one keyhole carries at least one protrusion recessed therein, said at least one protrusion receivable within said at least one recess of said at least one removable projecting key.

7. The combination interlocking toy and reusable canister of claim 6, wherein said at least one removable projecting key is formed on a first wall of said canister, and wherein an additional said at least one removable projecting key is formed on a second wall of said canister opposite said first wall.

8. A method of using a container as a toy building block, comprising the steps of:

a. obtaining two or more of a combination toy building block and container, said combination toy building block and container comprising at least one male connector disposed on a first wall of said combination toy building block and container and at least one female connector formed on a second wall of said combination toy building block and container, wherein said at least one female connector has a protrusion recessed therein, said protrusion dimensioned to be received by a channel formed on said at least one male connector upon engagement of said at least one male connector with said at least one female connector;

b. engaging said at least one male connector of a first combination toy building block and container with said at least one female connector of a second combination toy building block and container; and c. continuing to combine a plurality of said combination toy building block and containers to one another to form a desired configuration.

* * * * *